US009079734B2

(12) United States Patent
Shiraishi et al.

(10) Patent No.: US 9,079,734 B2
(45) Date of Patent: Jul. 14, 2015

(54) PAPER FEEDING DEVICE AND IMAGE FORMING DEVICE

(71) Applicant: SHARP KABUSHIKI KAISHI, Osaka-shi, Osaka (JP)

(72) Inventors: Yoshinori Shiraishi, Osaka (JP); Masaru Tsuji, Osaka (JP); Yasuaki Fukada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/373,787

(22) PCT Filed: Dec. 20, 2012

(86) PCT No.: PCT/JP2012/083115
§ 371 (c)(1),
(2) Date: Jul. 22, 2014

(87) PCT Pub. No.: WO2013/111483
PCT Pub. Date: Aug. 1, 2013

(65) Prior Publication Data

US 2014/0346727 A1 Nov. 27, 2014

(30) Foreign Application Priority Data

Jan. 27, 2012 (JP) ..... 2012-014921
Jan. 27, 2012 (JP) ..... 2012-014922

(51) Int. Cl.
*B65H 3/14* (2006.01)
*B65H 5/22* (2006.01)
(Continued)

(52) U.S. Cl.
CPC ..... *B65H 3/14* (2013.01); *B65H 3/128* (2013.01); *B65H 3/48* (2013.01); *B65H 5/222* (2013.01); *B65H 2406/364* (2013.01); *B65H 2406/42* (2013.01)

(58) Field of Classification Search
CPC ..... B65H 3/08; B65H 3/14; B65H 2406/35; B65H 2406/351; B65H 2406/3511; B65H 2406/352; B65H 2406/364; B65H 5/222
USPC ..... 271/11, 90, 104, 105, 106, 96–98
See application file for complete search history.

(56) References Cited

U.S. PATENT DOCUMENTS

2002/0145246 A1 10/2002 Goda et al.
2006/0170145 A1* 8/2006 Nakane ..... 271/97
(Continued)

FOREIGN PATENT DOCUMENTS

JP 10-316263 12/1998
JP 11-157678 6/1999
(Continued)

OTHER PUBLICATIONS

International Search Report for PCT/JP2012/083115 mailed Apr. 2, 2013.

*Primary Examiner* — Patrick Cicchino
(74) *Attorney, Agent, or Firm* — Nixon & Vanderhye, P.C.

(57) ABSTRACT

Disclosed is a paper feeding device (71) including: a paper stacking tray (74) that carries thereon stacked sheets of printing paper and moves up/down along a stacking direction of the sheets of printing paper; a paper transport member (e.g., paper transport belts (81)) that sucks and transports a sheet of printing paper from the paper stacking tray (74); a separation fan (88) that generates an air flow separating the printing paper stacked on the paper stacking tray (74); an air sucking fan (84) that generates an air flow sucking a sheet of printing paper stacked on the paper stacking tray (74); and a relay duct (87) that guides air coming out of the air sucking fan (84) to the separation fan (88). The relay duct (87) extends along a straight line from an air outlet (84*b*) of the air sucking fan (84) to an air inlet (88*a*) of the separation fan (88).

20 Claims, 13 Drawing Sheets

(51) Int. Cl.
*B65H 3/48* (2006.01)
*B65H 3/12* (2006.01)

(56) References Cited

U.S. PATENT DOCUMENTS

| | | | | |
|---|---|---|---|---|
| 2007/0170638 | A1 | 7/2007 | Ikeda | |
| 2007/0228638 | A1* | 10/2007 | Ikeda | 271/97 |
| 2009/0283958 | A1* | 11/2009 | Takahashi | 271/12 |
| 2013/0106047 | A1* | 5/2013 | Tsuji et al. | 271/94 |
| 2013/0127108 | A1* | 5/2013 | Shiraishi et al. | 271/11 |

FOREIGN PATENT DOCUMENTS

| | | |
|---|---|---|
| JP | 2001-39556 | 2/2001 |
| JP | 2002-226068 | 8/2002 |
| JP | 2006-213458 | 8/2006 |
| JP | 2007-191293 | 8/2007 |
| JP | 2007-261719 | 10/2007 |
| JP | 2009-190840 | 8/2009 |
| JP | 2010-215350 | 9/2010 |
| JP | 2010-247970 | 11/2010 |

* cited by examiner

PAPER FEEDING DEVICE AND IMAGE FORMING DEVICE

This application is the U.S. national phase of International Application No. PCT/JP2012/083115 filed 20 Dec. 2012 which designated the U.S. and claims priority to JP 2012-014921 filed 27 Jan. 2012, and JP 2012-014922 filed 27 Jan. 2012, the entire contents of each of which are hereby incorporated by reference.

TECHNICAL FIELD

The present invention relates to paper feeding devices equipped with a paper transport member for transporting printing paper stacked on a paper stacking tray by sucking the printing paper and also relates to image forming devices equipped with such a paper feeding device.

BACKGROUND ART

Conventional printers, copying machines, and like image forming devices include a paper feeding device that removes, a sheet at a time, printing paper from a stack on a paper feed tray to feed the sheets individually to an image forming section. The paper feeding device employs one of various mechanisms, such as separation claws, friction pads, and gating, to remove printing paper, a sheet at a time, from a paper feed tray. Many other mechanisms have been also developed by which air is blown at printing paper so that individual sheets can be levitated and separated.

An air blowing device that includes an air blowing fan and an air sucking fan is discussed as a type of paper feeding device that blows air for paper separation (see, for example, Patent Document 1). In the paper feeding device of Patent Document 1, the air blowing fan separates printing paper on a paper feed tray by blowing air at the printing paper. The air sucking fan then draws the separated sheet of printing paper onto a paper feeding belt via an air inlet. The air blowing device is enclosed in a shield member provided with the air inlet to block unwanted noise generated by the air blowing device.

Another type of paper feeding device is discussed which reshapes each sheet of printing paper to be drawn onto a transport belt into an arch form to achieve improved printing paper separation (see, for example, Patent Document 2). In the paper feeding device of Patent Document 2, an air blowing fan blows air at printing paper, and an air sucking fan draws the printing paper onto a transport belt via an air sucking duct that has an air sucking port on its bottom wall. The transport belt is curved by a rib standing out of the bottom wall of the air sucking duct so that the printing paper drawn onto the transport belt is reshaped into an arch form. This mechanism provides an air passage between the printing paper drawn onto the transport belt and the printing paper on a paper feed plate.

These paper feeding devices use a single fan as both the air sucking fan and the air blowing fan. Another type of paper feeding device is discussed which includes two fans that are coupled together (see, for example, Patent Documents 3 and 4).

In the paper feeding device of Patent Document 3, the air outlet of one of the fans and the air inlet of the other fan is linked by a coupling passage so that the two fans can suck in air to draw a sheet of printing paper onto a transport belt. The air blown out of the air outlet of the other fan is aimed at a printing paper storage section on which there is provided a paper feed tray. The paper feeding device levitates and separates printing paper by a levitation air blowing mechanism that blows air at a side face of the stack of printing paper on the paper feed tray and a separation air blowing mechanism that blows air at the front of the printing paper drawn onto the transport belt. The air sucking forces of the individual fans are added up by positioning the two fans in series, to generate a sufficient drawing force.

In the media feeding device of Patent Document 4, there is provided air supply means in which the air outlet of an upstream fan is coupled to the air outlet of the downstream fan via a spiral channel. The air supply means blows air to levitate several sheets from the stack of sheets on a sheet tray. Above the stack of sheets is there also provided suction/transport means including a suction fan that sucks in air to draw the sheet levitated from the sheet tray onto a transport belt. The two coupled fans generate high-pressure air to unfailingly separate and levitate sheets.

CITATION LIST

Patent Literature

Patent Document 1: Japanese Patent Application Publication, Tokukaihei, No. 11-157678

Patent Document 2: Japanese Patent Application Publication, Tokukai, No. 2001-39556

Patent Document 3: Japanese Patent Application Publication, Tokukai, No. 2010-215350

Patent Document 4: Japanese Patent Application Publication, Tokukai, No. 2007-261719

SUMMARY OF THE INVENTION

Problems to be Solved by the Invention

Fans used in a paper feeding device need to generate strong air sucking force to unfailingly separate and levitate printing paper. For greater air sucking force, physically larger fans should be used, as an example. However, a physically large fan disadvantageously could not operate on the same power source as the image forming device.

A first issue for the present invention is related to air sucking force for printing paper.

Fans used in a paper feeding device need to generate strong air sucking force to unfailingly separate and levitate printing paper. For greater air sucking force, physically larger fans should be used, as an example. However, a physically large fan disadvantageously could not operate on the same power source as the image forming device.

In the paper feeding device of Patent Document 1, the air blowing device drives two fans with a single blower motor. Therefore, the air blowing device disadvantageously needs a dedicated power source similarly to a physically large fan. Another problem is that sufficient air sucking force is not available because the air sucking fan and the air blowing fan are independently provided.

The paper feeding device of Patent Document 2 has the same problem: sufficient air sucking force is not available because the air sucking fan and the air blowing fan are independently provided.

In the paper feeding device of Patent Document 3, the air inlet is provided along the axis of the blade wheel, and the air outlet is provided along a tangent to the blade wheel. The two fans are stacked vertically with their air inlets looking upwards. Since the air outlet of one of the fans and the air inlet of the other fan are provided in different directions, the coupling passage needs to have a bend to link the two fans. In the bend, the wall face and other obstacles disrupt an air flow, causing a loss in the air flow. This structure of the paper feeding device hence inevitably has a problem that the air sucking force decreases as air flows through the coupling passage. The paper feeding device needs a fan to levitate printing paper in addition to the fans linked in series.

In the media feeding device of Patent Document 4, two fans are linked by a spiral channel in which the wall face and other obstacles change the direction of an air flow, inevitably resulting in a problem that the wind pressure decreases as air passes through the spiral channel. The media feeding device needs a suction fan in addition to the fans linked by the spiral channel.

The present invention, in view of the first issue, has an object to provide a paper feeding device and an image forming device that are capable of mutually reinforcing the force that draws printing paper and the force that separates printing paper by connecting an air sucking fan and a separation fan.

A second issue for the present invention is related to reduction of the image forming device in size.

The paper feeding device needs to be reduced further in size to realize a more compact image forming device with higher functionality. For these purposes, it is proposed to reduce the size of the housing by reducing the footprint of the paper feeding device and to add more components.

In the paper feeding device of Patent Document 1, the air blowing device is covered with a shield member, and a shield plate is provided inside the shield member. The structure requires a large space around the air blowing device, which hampers easy size reduction.

In the paper feeding device of Patent Document 2, sufficient air sucking force is not available because the air sucking fan and the air blowing fan are independently provided.

The paper feeding device of Patent Document 3 needs a fan to levitate printing paper in addition to the fans linked in series. Therefore, the paper feeding device needs a sufficient space to accommodate the three fans, which again hampers easy size reduction.

The media feeding device of Patent Document 4 needs a suction fan in addition to the fans linked by the spiral channel. Therefore, the media feeding device needs a sufficient space to accommodate the three fans, which again hampers easy size reduction.

None of Patent Documents 1 to 4 discusses correlation between the shape of the fans and the shape of the duct that constitutes an air channel in reducing the size of the paper feeding device.

The present invention, in view of the second issue, has an object to provide a paper feeding device and an image forming device that are capable of allowing for size reduction by reducing the width in a longitudinal direction and the width in a transport direction as much as possible.

Solution to Problem

A paper feeding device in accordance with a first aspect of the present invention includes: a paper stacking tray that carries thereon stacked sheets of printing paper and moves up/down along a stacking direction of the sheets of printing paper; a paper transport member that sucks in air to suck and transport a sheet of printing paper stacked on the paper stacking tray; a separation fan that generates an air flow separating the printing paper stacked on the paper stacking tray; an air sucking fan that generates an air flow sucking the sheet of printing paper stacked on the paper stacking tray; and a relay duct that guides air coming out of the air sucking fan to the separation fan, wherein the relay duct extends along a straight line from an air outlet of the air sucking fan to an air inlet of the separation fan.

According to the structure, an air sucking fan and a separation fan are connected so that one of the fans can compensate for insufficiency of the air generated by the other fan. The fans thus mutually reinforce the force that draws printing paper and the force that separates printing paper. In other words, the air sucking fan not only exerts a force that draws (sucks) printing paper, but also exerts a force that separates printing paper, whereas the separation fan not only exerts a force that separates printing paper, but also exerts a force that draws printing paper. Forming a relay duct along a straight line eliminates wall faces and other obstacles from its structure, reducing loss of an air flow during its passage in the relay duct. Using a fewer fans allows for a more compact, less power-consuming paper feeding device.

Preferably, the paper feeding device in accordance with the present invention further includes a separation duct that, connected to an air outlet of the separation fan, constitutes a channel for air separating the printing paper, wherein the relay duct and the separation duct are coupled at a predetermined angle, and the separation fan is disposed where the relay duct and the separation duct are coupled.

This structure changes the direction of the air that flows through the separation fan and provides a separation duct along the air flow coming from the separation fan. That in turn reduces the loss that would otherwise be caused by wall faces and other obstacles, thereby achieving efficient printing paper separation.

Preferably, in the paper feeding device in accordance with the present invention, the predetermined angle is equal to 90°.

According to the structure, the relay duct and the separation duct are coupled at a 90° angle. That enables air to be fed normal to the air inlet of the separation fan. The separation fan hence collects air efficiently.

Preferably, the paper feeding device in accordance with the present invention further includes an air sucking duct that, connected to an air inlet of the air sucking fan, constitutes a channel for air sucking a sheet of printing paper, wherein the air sucking duct sucks in air coming out of the separation duct.

According to the structure, the air sucking duct sucks in part of the air coming out of the separation duct to form an air channel between the separation duct and the air sucking duct. This enables an air circulation in the paper feeding device, which reduces loss of an air flow for efficient operation.

Preferably, in the paper feeding device in accordance with the present invention, the relay duct has an opening that faces blades of the separation fan.

According to the structure, the air coming out of the relay duct directly hits the blades of the separation fan, which enables efficient feeding of air to the separation fan.

Preferably, in the paper feeding device in accordance with the present invention, the air outlet of the air sucking fan is disposed at such a position that the air outlet of the air sucking fan overlaps a part of an air sucking region from which the separation fan sucks in air and that an area in which the air outlet of the air sucking fan overlaps the air sucking region is maximized.

According to the structure, the separation fan sucks in as much of the air coming out of the air sucking fan as possible. That in turn increases the air coming out of the separation fan.

Preferably, in the paper feeding device in accordance with the present invention, the air sucking region is shaped like a circular ring, and the air outlet of the air sucking fan is rectangular, when viewed normal to a plane in which the air inlet of the separation fan lies, and one of sides of a projection of the air outlet of the air sucking fan onto the separation fan matches a tangent to an external circle of the air sucking region.

The structure specifies the position of the air outlet of the air sucking fan. That in turn facilitates designing of a structure that maximizes the area in which the air outlet of the air sucking fan overlaps the air sucking region.

A paper feeding device in accordance with a second aspect of the present invention includes: a paper stacking tray that carries thereon stacked sheets of printing paper and moves up/down along a stacking direction of the sheets of printing paper; a paper transport member that sucks in air to suck and transport a sheet of printing paper stacked on the paper stacking tray; letting a longitudinal direction be along a front end of the printing paper stacked on the paper stacking tray, a separation duct that, disposed facing the front end of the printing paper stacked on the paper stacking tray, constitutes a channel for air separating the printing paper; a separation fan that, coupled to an end of the separation duct with respect to the longitudinal direction, generates an air flow separating the printing paper stacked on the paper stacking tray; an air sucking duct that, disposed in the longitudinal direction facing a top face of the printing paper stacked on the paper stacking tray, constitutes a channel for air sucking the sheet of printing paper stacked on the paper stacking tray; and an air sucking fan that, coupled to an end of the air sucking duct with respect to the longitudinal direction, generates an air flow sucking the sheet of printing paper stacked on the paper stacking tray, wherein the air sucking fan is disposed so that a longitudinal direction of the air sucking duct matches a minimum width direction of the air sucking fan, the separation duct is disposed so that the longitudinal direction of the air sucking duct is along a longitudinal direction of the separation duct and that a transport direction of the printing paper matches a minimum width direction of the separation duct, and the separation fan is disposed so that the minimum width direction of the separation duct is along a minimum width direction of the separation fan.

According to the structure, the minimum width direction of the air sucking fan matches the longitudinal direction of the air sucking duct. That reduces the width of the paper drawing section constituted by the ducts and fans in the longitudinal direction. The matching of the minimum width directions of the separation duct and the separation fan with the transport direction reduces the width of the paper drawing section in the transport direction. Reducing the widths in the longitudinal and transport directions to possible minimums allows for reduction of the paper feeding device in size. Providing the coupled air sucking fan and separation fan mutually reinforces the force that draws printing paper and the force that separates printing paper.

Preferably, in the paper feeding device in accordance with the present invention, the separation fan has an air outlet in a plane normal to the longitudinal direction, the air outlet of the separation fan being wider in the stacking direction than in the transport direction.

According to the structure, the air outlet of the separation fan is wider in the stacking direction, which ensures a sufficient cross-sectional area for the channel. Since the separation fan and the separation duct have their minimum width directions matched with the transport direction, the separation fan and the separation duct are not allowed to have an increased width in the transport direction. The widths can however be readily increased in the stacking direction in which a predetermined area is ensured for the provision of the paper stacking tray.

Preferably, in the paper feeding device in accordance with the present invention, the air sucking fan has an air outlet in a plane normal to the transport direction, the air outlet of the air sucking fan being wider in the stacking direction than in the longitudinal direction.

According to the structure, the air outlet of the air sucking fan is wider in the stacking direction, which ensures a sufficient cross-sectional area for the channel. Since the air sucking fan has its minimum width direction matched with the longitudinal direction of the air sucking duct, the air sucking fan is not allowed to have an increased width in the longitudinal direction. The width can however be readily increased in the stacking direction in which a predetermined area is ensured for the provision of the paper stacking tray.

Preferably, the paper feeding device in accordance with the present invention further includes a relay duct that guides air coming out of the air sucking fan to the separation fan, wherein the relay duct and the separation duct are coupled at a predetermined angle, and the separation fan is disposed where the relay duct and the separation duct are coupled.

This structure changes the direction of the air that flows through the separation fan and provides a separation duct along the air flow coming from the separation fan. That in turn reduces the loss that would otherwise be caused by wall faces and other obstacles, thereby achieving efficient printing paper separation.

Preferably, in the paper feeding device in accordance with the present invention, the predetermined angle is equal to 90°.

According to the structure, the relay duct and the separation duct are coupled at a 90° angle. That enables air to be fed normal to the air inlet of the separation fan. The separation fan hence collects air efficiently.

Preferably, in the paper feeding device in accordance with the present invention, the relay duct has an opening that faces blades of the separation fan.

According to the structure, the air coming out of the relay duct directly hits the blades of the separation fan, which enables efficient feeding of air to the separation fan.

Preferably, in the paper feeding device in accordance with the present invention, the air sucking fan and the separation fan have a common structure.

According to the structure, the air sucking fan is identical to the separation fan, which facilitates reduction of unwanted noise generated by the fans. Since the fans have approximately equal rotational speeds and cycles, the frequencies of their unwanted noise are confined to a narrow range of frequencies. The noise can be thus reduced without addressing a wide range of frequencies.

Preferably, in the paper feeding device in accordance with the present invention, the separation fan generates a higher wind pressure than does the air sucking fan.

According to the structure, the separation fan generates an increased wind pressure, which compensates for the loss that occurs during passage in the relay duct. A longer channel inevitably lowers the wind pressure, albeit slightly. An output difference between the fans ensures a consistent wind pressure.

An image forming device in accordance with the present invention includes a paper feeding device in accordance with the present invention.

According to the structure, the image forming device, including a paper feeding device in accordance with the present invention, achieves the same functions and effects as the paper feeding device in accordance with the present invention.

Advantageous Effects of the Invention

First effects of the present invention are that connecting the air sucking fan and the separation fan enables one of the fans to compensate for insufficiency of the air generated by the other fan, the fans thus mutually reinforcing the force that draws printing paper and the force that separates printing paper. In other words, the air sucking fan not only exerts a force that draws printing paper, but also exerts a force that separates printing paper, whereas the separation fan not only exerts a force that separates printing paper, but also exerts a force that draws printing paper. Forming a relay duct along a straight line eliminates wall faces and other obstacles from its structure, reducing loss of an air flow during its passage in the relay duct. Using a fewer fans allows for a more compact, less power-consuming paper feeding device.

Second effects of the present invention are that matching the minimum width direction of the air sucking fan and the longitudinal direction of the air sucking duct reduces the width of the paper drawing section constituted by the ducts and fans in a longitudinal direction. The matching of the minimum width directions of the separation duct and the separation fan with the transport direction reduces the width of the paper drawing section in the transport direction. Reducing the widths in the longitudinal and transport directions to possible minimums allows for reduction of the paper feeding device in size. Providing the coupled air sucking fan and separation fan mutually reinforces the force that draws printing paper and the force that separates printing paper.

DESCRIPTION OF EMBODIMENTS

The following will describe an image forming device in accordance with an embodiment of the present invention in reference to drawings.

Figure 1:
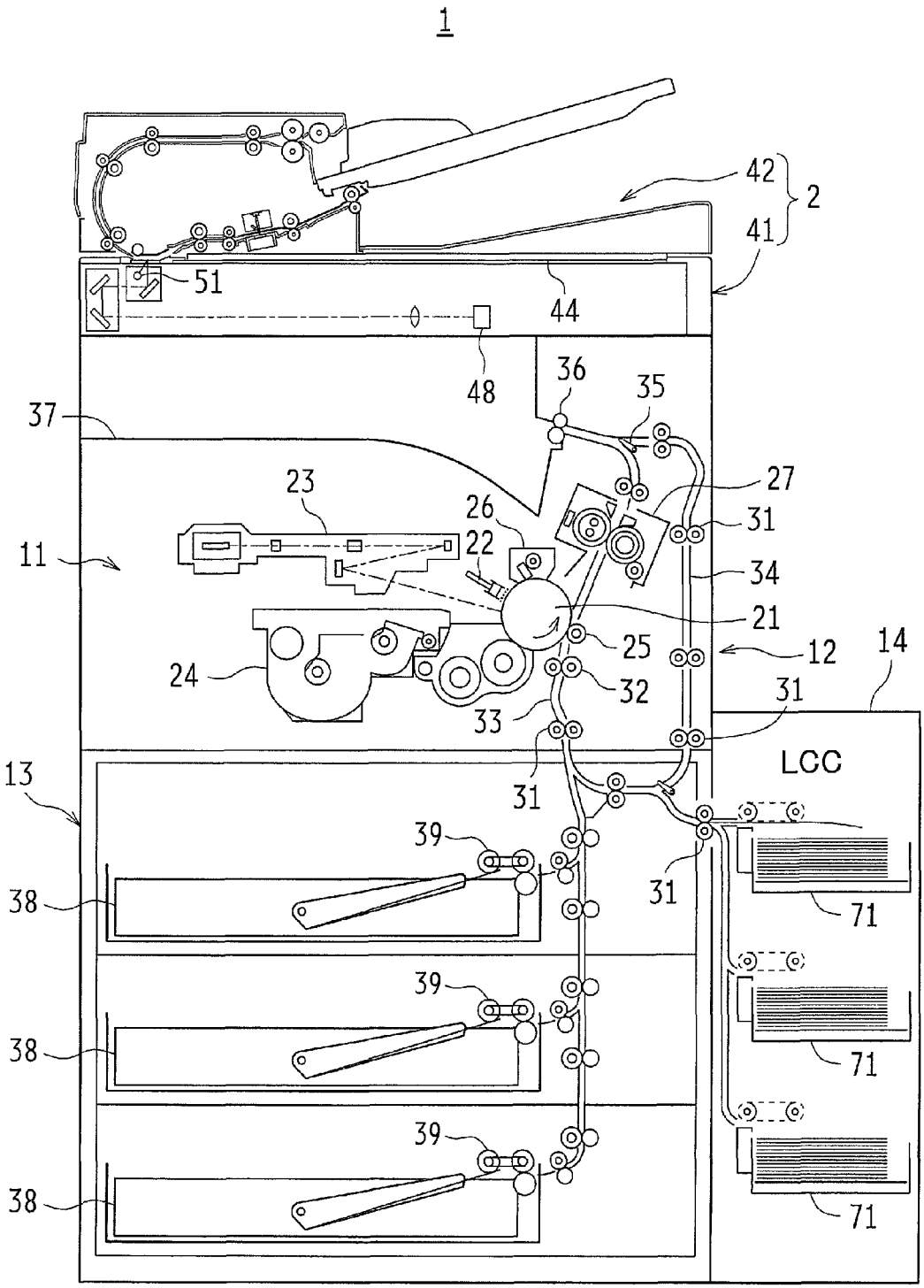
FIG. 1 is a schematic side view of an image forming device in accordance with an embodiment of the present invention.

FIG. 1 is a schematic side view of an image forming device in accordance with an embodiment of the present invention.

An image forming device 1 includes an original reading section 2, an image forming section 11, a paper transport section 12, a paper supply section 13, and a large capacity paper feeding cassette (large capacity cassette, or LCC) 14, to form an image represented by image data on printing paper. The image forming device 1 generates image data by capturing an original document image in the original reading section 2 or receives image data from, for example, an external terminal device. The image forming device 1 subjects the obtained image data to various image processing and forms an image represented by the resultant image data on printing paper in the image forming section 11.

The original reading section 2, disposed above the image forming section 11, includes an optical reading section 41 (bottom) and an original document transport section 42 (top).

The optical reading section 41 includes an original document tray 44 and an original reading glass on top thereof and a light source 51 and a solid-state image capturing element 48 inside thereof. The original document tray 44 and the original reading glass are made of transparent glass. The front side of an original document placed either on the original document tray 44 or on the original reading glass is illuminated by a light source 51. Reflected light is guided to the solid-state image capturing element 48 via reflective mirrors, lenses, etc. The solid-state image capturing element 48 generates image data based on incoming reflected light.

The original document transport section 42 automatically transports the original document onto the original reading glass. The original document transport section 42 is structured so that it can pivot freely around an axis that couples the image forming section 11 and the original document transport section 42. Hence, an original document may be manually placed when the top of the original document tray 44 is opened.

The image forming section 11 includes a photosensitive drum 21 and a fusing device 27 on a transport path 33. Around the photosensitive drum 21 are there disposed a charger device 22, a laser emission device 23, a developer device 24, a transfer roller 25, and a cleaning device 26.

The photosensitive drum 21 has a photosensitive layer on its surface and rotates as indicated by an arrow. The surface of the photosensitive drum 21 is cleaned by the cleaning device 26 before uniformly charged to a predetermined electric potential by the charger device 22. The laser emission device 23 is a laser scanning unit (LSU) including a laser diode and reflective mirrors. The laser emission device 23 scans the surface of the photosensitive drum 21 with a laser beam and writes an electrostatic latent image on the surface of the photosensitive drum 21 according to incoming image data. The developer device 24 develops the electrostatic latent image written on the surface of the photosensitive drum 21 with toner to form a toner image on the surface of the photosensitive drum 21.

The transfer roller 25 is brought into contact with the photosensitive drum 21 under pressure to form a nip region between the transfer roller 25 and the photosensitive drum 21 and rotates together with the photosensitive drum 21. The photosensitive drum 21 and the transfer roller 25 transport incoming printing paper that has been transported via the transport path 33, by nipping the printing paper in the nip region, and transfer the toner image on the surface of the photosensitive drum 21 onto the printing paper. The printing paper onto which the toner image has been transferred is transported to the fusing device 27 via the transport path 33.

The fusing device 27 nips printing paper, for example, between rollers to apply heat and pressure while the printing paper is passing therethrough, to fuse the toner image transferred onto the printing paper. Thereafter, the printing paper is ejected via discharge rollers 36 and stacked on the discharge tray 37.

The paper transport section 12 includes transport rollers 31, registration rollers 32, a transport path 33, a bypass path 34, a branch claw 35, discharge rollers 36, and a discharge tray 37.

The paper supply section 13 includes paper feeding cassettes 38. Each paper feeding cassette 38 includes, for example, pickup rollers 39 to draw out and send the printing paper, a sheet at a time, down the transport path 33.

The large capacity paper feeding cassette 14 includes a paper feeding device 71 that contains stacked sheets of printing paper. The paper feeding device 71 draws out and sends the printing paper, a sheet at a time, down the transport path 33. Details will be given later about the paper feeding device 71 in reference to FIG. 2.

In the image forming device 1, the printing paper is transported by the transport rollers 31 via the transport path 33 and ejected onto the discharge tray 37 via the transfer roller 25 and the fusing device 27. In the transport path 33, the printing paper is temporarily stopped by the registration rollers 32 disposed before the photosensitive drum 21. After that, the printing paper is transported at a proper transfer timing in view of the toner image on the surface of the photosensitive drum 21.

If an image is to be formed on the backside of the printing paper after an image is formed on the front side, the branch claw 35 is switched in such a manner as to transport the printing paper in the opposite direction from the discharge rollers 36 to the bypass path 34. The printing paper is turned over in the bypass path 34 and again guided to the registration rollers 32 to form an image on the backside of the printing paper in the same manner as on the front side before discharging the printing paper onto the discharge tray 37.

Next, a paper feeding device in accordance with an embodiment of the present invention will be described in reference to drawings.

Figure 2:
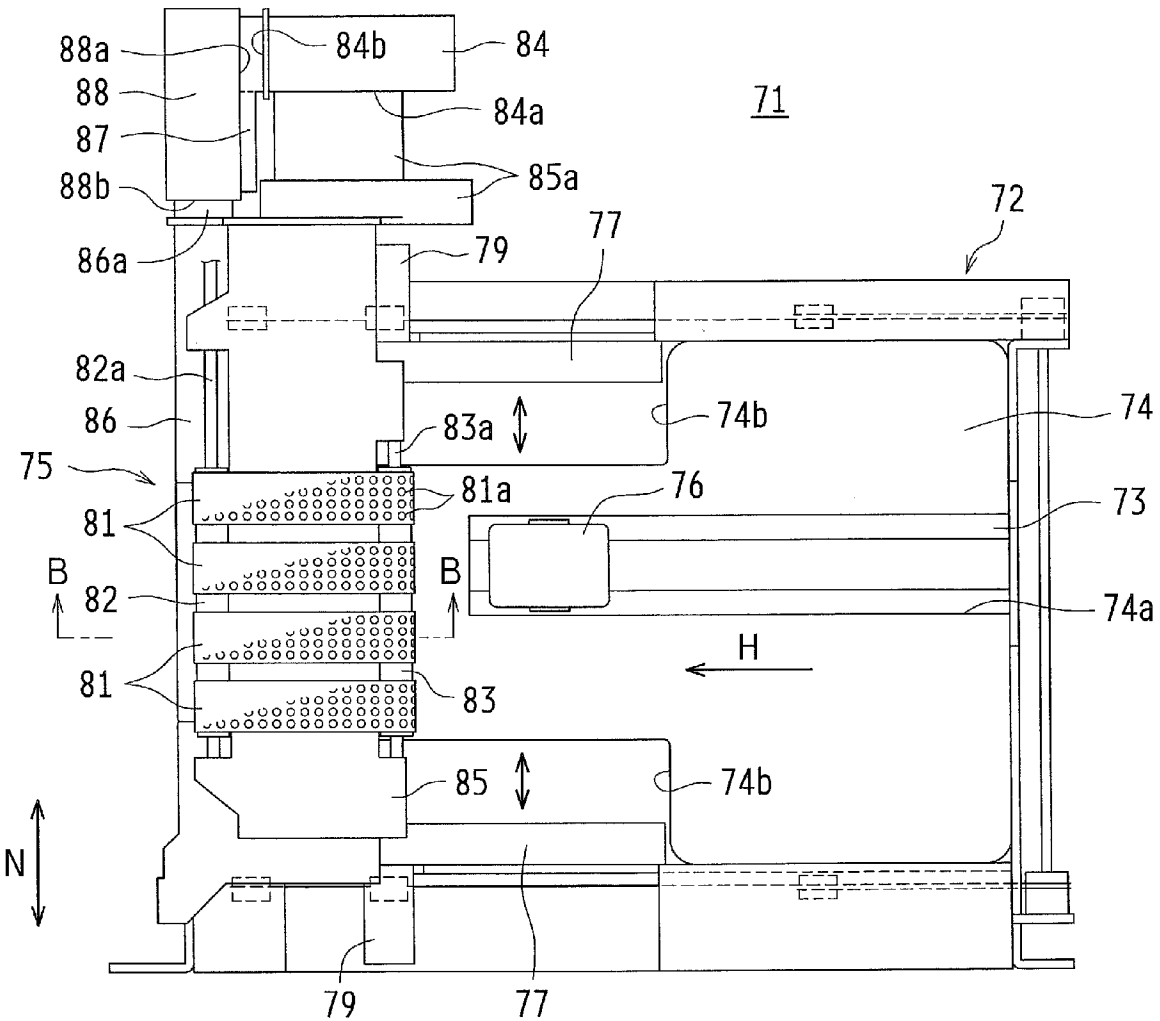
FIG. 2 is a plan view of a paper feeding device in accordance with an embodiment of the present invention.

FIG. 2 is a plan view of a paper feeding device in accordance with an embodiment of the present invention.

A paper feeding device 71 in accordance with an embodiment of the present invention includes a paper stacking tray 74, a paper transport member (e.g., paper transport belts 81), a separation fan 88, an air sucking fan 84, and a relay duct 87. The paper stacking tray 74 carries thereon stacked sheets of printing paper and moves up/down along a stacking direction, S, of the sheets of printing paper (see FIG. 3 which will be described later in detail). The paper transport member sucks in air to suck and transport a sheet of printing paper stacked on the paper stacking tray 74. The separation fan 88 generates an air flow separating the printing paper stacked on the paper stacking tray 74. The air sucking fan 84 generates an air flow sucking a sheet of printing paper stacked on the paper stacking tray 74. The relay duct 87 guides the air coming out of the air sucking fan 84 to the separation fan 88. The relay duct 87 extends along a straight line from an air outlet 84*b* of the air sucking fan 84 to an air inlet 88*a* of the separation fan 88.

According to the structure, the air sucking fan 84 and the separation fan 88 are connected so that one of the fans can compensate for insufficiency of the air generated by the other fan. The fans thus mutually reinforce the force that draws printing paper and the force that separates printing paper. In other words, the air sucking fan 84 not only exerts a force that draws printing paper, but also exerts a force that separates printing paper, whereas the separation fan 88 not only exerts a force that separates printing paper, but also exerts a force that draws printing paper. Forming the relay duct 87 along a straight line eliminates wall faces and other obstacles from its structure, reducing loss of an air flow during its passage in the relay duct 87. Using a fewer fans allows for a more compact, less power-consuming paper feeding device.

The paper feeding device 71 includes an air sucking duct 85 that, connected to an air inlet 84*a* of the air sucking fan 84, constitutes a channel for air sucking a sheet of printing paper and a separation duct 86 that, connected to an air outlet 88*b* of the separation fan 88, constitutes a channel for air separating the printing paper.

As illustrated in FIG. 2, the paper feeding device 71 includes an outer frame assembly 72, a bottom plate 73, a paper stacking tray 74, and a paper drawing section 75. The paper drawing section 75 is disposed above an edge of the outer frame assembly 72 and constituted by four paper transport belts 81, a set of rollers 82 and 83 around which the paper transport belts 81 are stretched, the air sucking duct 85, the air sucking fan 84, the relay duct 87, the separation fan 88, and the separation duct 86. In the following, the outer frame assembly 72, the bottom plate 73, and the paper stacking tray 74 will be described first in reference to FIGS. 2 and 3, and the paper drawing section 75 will be described later in detail.

Figure 3:
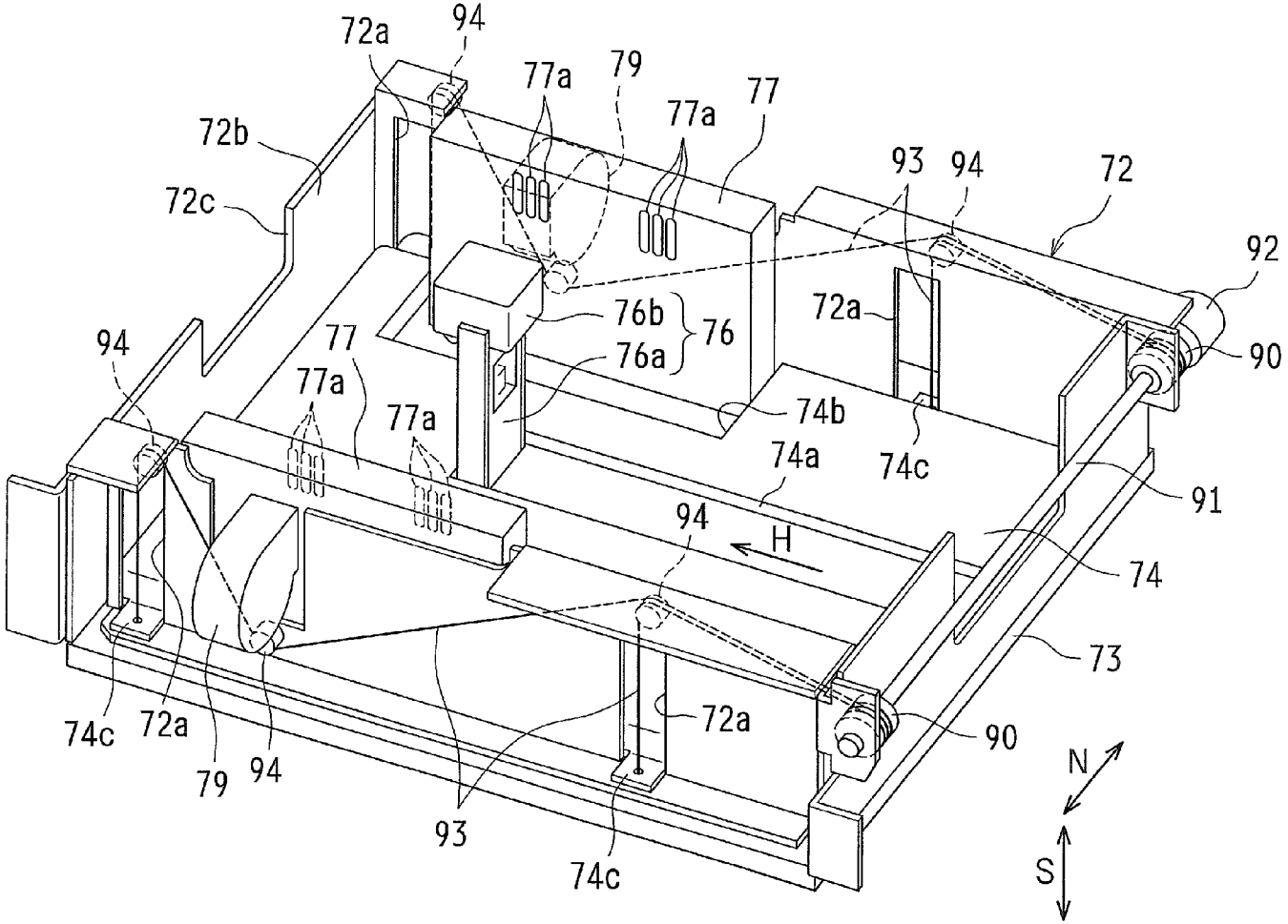
FIG. 3 is a perspective view of an outer frame assembly, a bottom plate, and a paper stacking tray, with a paper drawing section being removed.

FIG. 3 is a perspective view of an outer frame assembly, a bottom plate, and a paper stacking tray, with a paper drawing section being removed.

The paper stacking tray 74 has open groove sections 74*a* extending in the transport direction H of the printing paper. There is provided a printing paper rear end guide 76 in the open groove sections 74*a* so that the printing paper rear end guide 76 stands out of the open groove sections 74*a*. The end of the printing paper stacked on the paper stacking tray 74 as pointed at by the arrow representing the transport direction H may be referred to as the "front end." The opposite end may be referred to as the "rear end." The direction indicated by the transport direction H may be referred to as "forward." The opposite direction may be referred to as "backward." The direction of the front end of the printing paper stacked on the paper stacking tray 74 is taken as the longitudinal direction N.

The printing paper rear end guide 76 includes a guiding pillar section 76*a* that faces the rear end of the printing paper stacked on the paper stacking tray 74 and a guiding head section 76*b* supported by the guiding pillar section 76*a*. The printing paper rear end guide 76 is supported so that the guide 76 can move reciprocally along the transport direction H of the printing paper in the open groove sections 74*a* on the bottom plate 73 and be fixed at any given position. Moving the printing paper rear end guide 76 forward causes the guiding pillar section 76*a* to come into contact with the rear end of the printing paper; elevating the paper stacking tray 74 causes the top face of the printing paper to come into contact with the guiding head section 76*b*.

There is provided a stack tray dent section 74*b* on either side of the paper stacking tray 74 with respect to its longitudinal direction N and an auxiliary duct 77 in each stack tray dent section 74*b*. The two auxiliary ducts 77 are supported by the outer frame assembly 72 so that the ducts 77 can move reciprocally along the longitudinal direction N in the stack tray dent section 74*b*, move in conjunction closer to, or away from, each other, and fixed at any given position.

The outer frame assembly 72 is provided in such a manner as to surround the printing paper stacked on the paper stacking tray 74 in a planar view and includes frame assembly openings 72*a*, two on either side of the assembly 72 with respect to its longitudinal direction N, and a contact plate 72*b* into which the front end of the printing paper comes into contact. From each assembly opening 72*a*, a protrusion 74*c* formed on the paper stacking tray 74 extends outside the outer frame assembly 72. The contact plate 72*b* has a notch section 72*c* where the contact plate 72*b* faces a first separation opening 86*b* (see FIGS. 5 and 7 which will be detailed later) of the separation duct 86.

Each auxiliary duct 77 is a hollow body with auxiliary openings 77*a* on a face thereof that faces a side of the printing paper stacked on the paper stacking tray 74 and has an internal air passage. There is provided an auxiliary fan 79 outside each auxiliary duct 77. The air sucked in by the auxiliary fan 79 is fed to the air passage in the auxiliary duct 77 and blown into the outer frame assembly 72 through the auxiliary openings 77*a*.

A wind-up pulley 90 is provided on each side of the outer frame assembly 72 with respect to the longitudinal direction N outside the outer frame assembly 72. Each wind-up pulley 90 is connected to two wires 93 that are in turn each connected to one of the protrusions 74*c* that is disposed on the same side as that wind-up pulley 90. The wires 93 are routed over driven pulleys 94 and connected to the wind-up pulley 90. In other words, a wire 93 is connected to each of the four protrusions 74*c*. The two wind-up pulleys 90 are fixed at the ends of a common rod 91 that is supported in a freely rotatable manner. A pulse motor 92 connected to the rod 91 drives/rotates the rod 91 for positive and negative rotation of the wind-up pulleys 90. The rotation in turn causes the wires 93 to be wound on, and unwound from, the wind-up pulleys 90. The winding and unwinding of the wires 93 moves up/down the paper stacking tray 74 along the stacking direction S. The height of the paper stacking tray 74 is adjustable by controlling the direction and angle of rotation of the pulse motor 92.

Next, the structure of the paper drawing section will be described in detail in reference to FIGS. 4 to 7.

Figure 4:
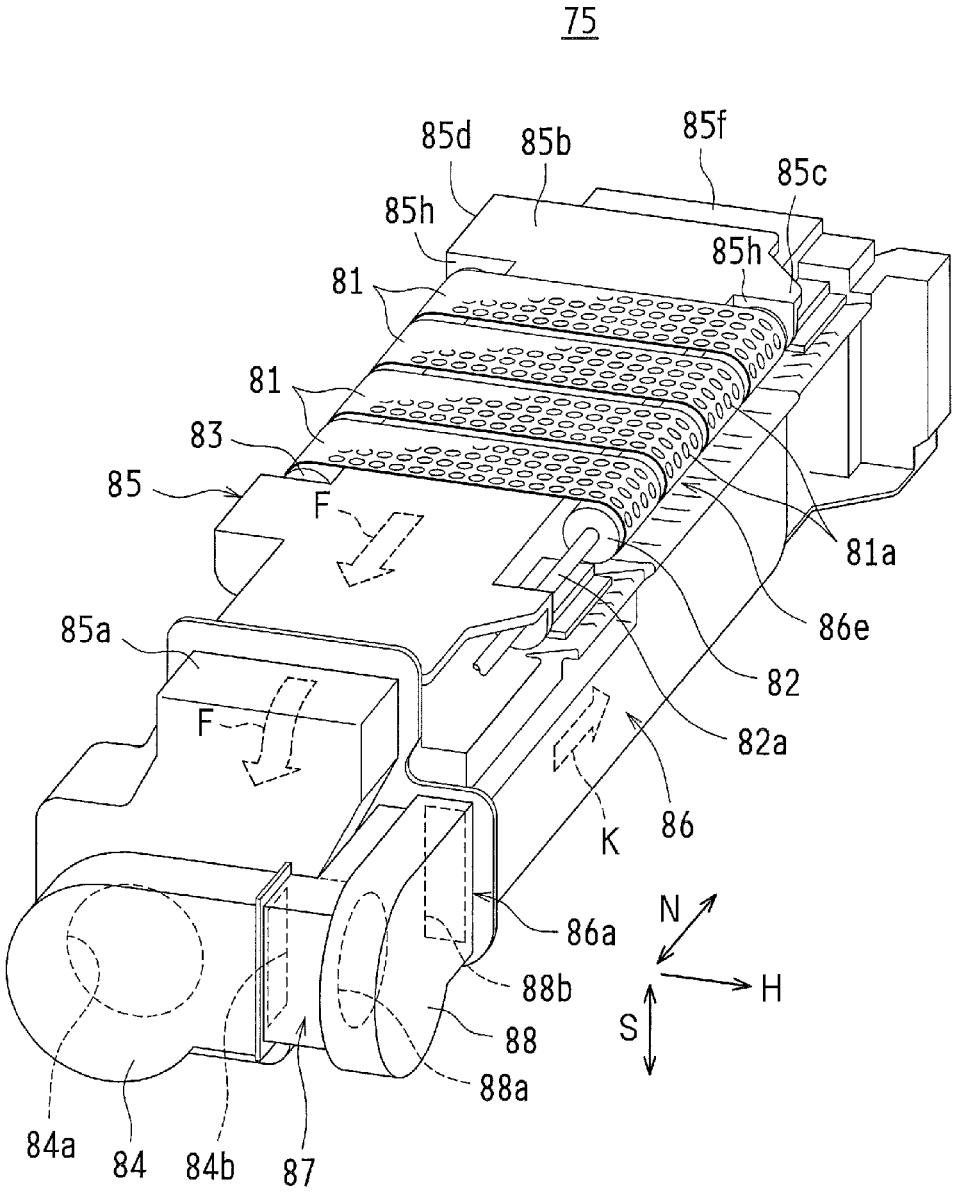
FIG. 4 is a perspective view of the paper drawing section as viewed obliquely downward from the front.
Figure 5:
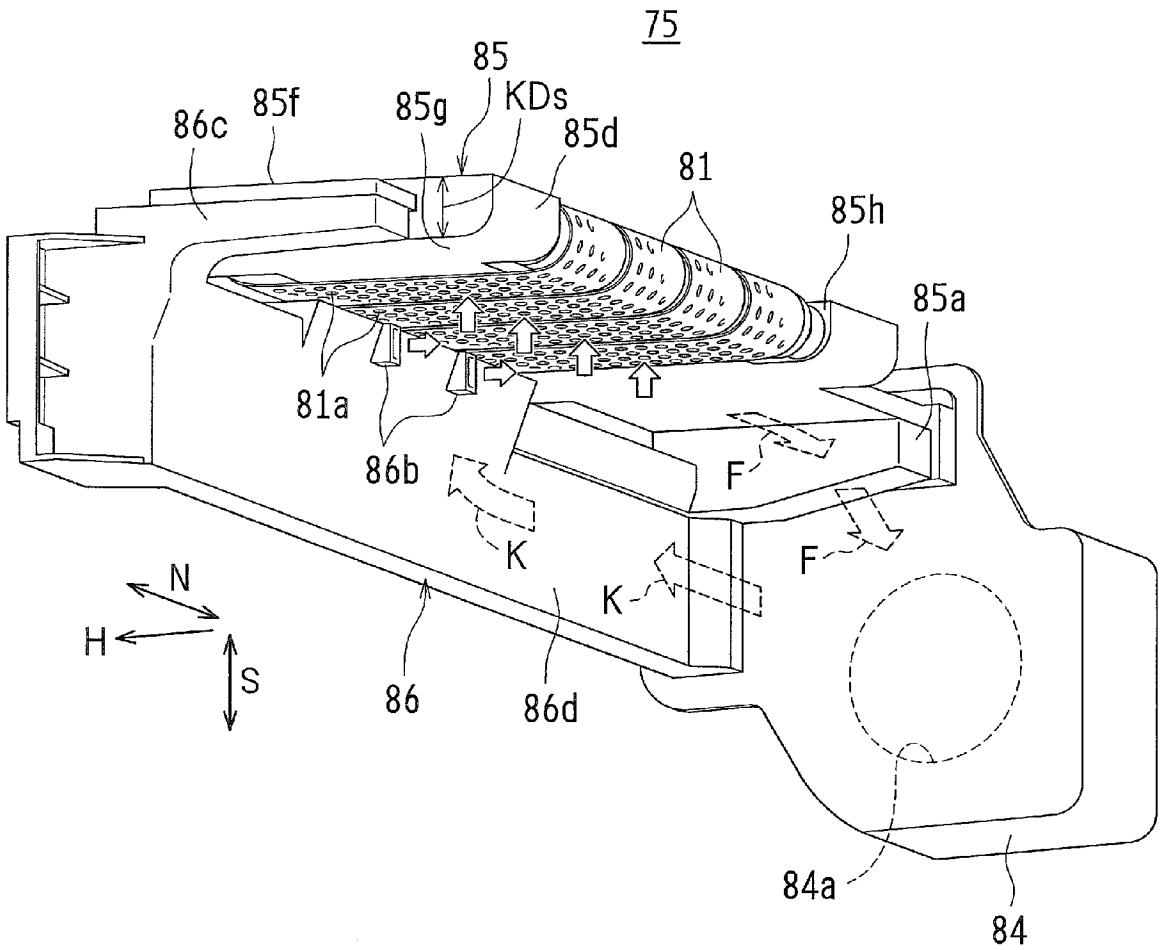
FIG. 5 is a perspective view of the paper drawing section as viewed obliquely upward from the rear.
Figure 6:
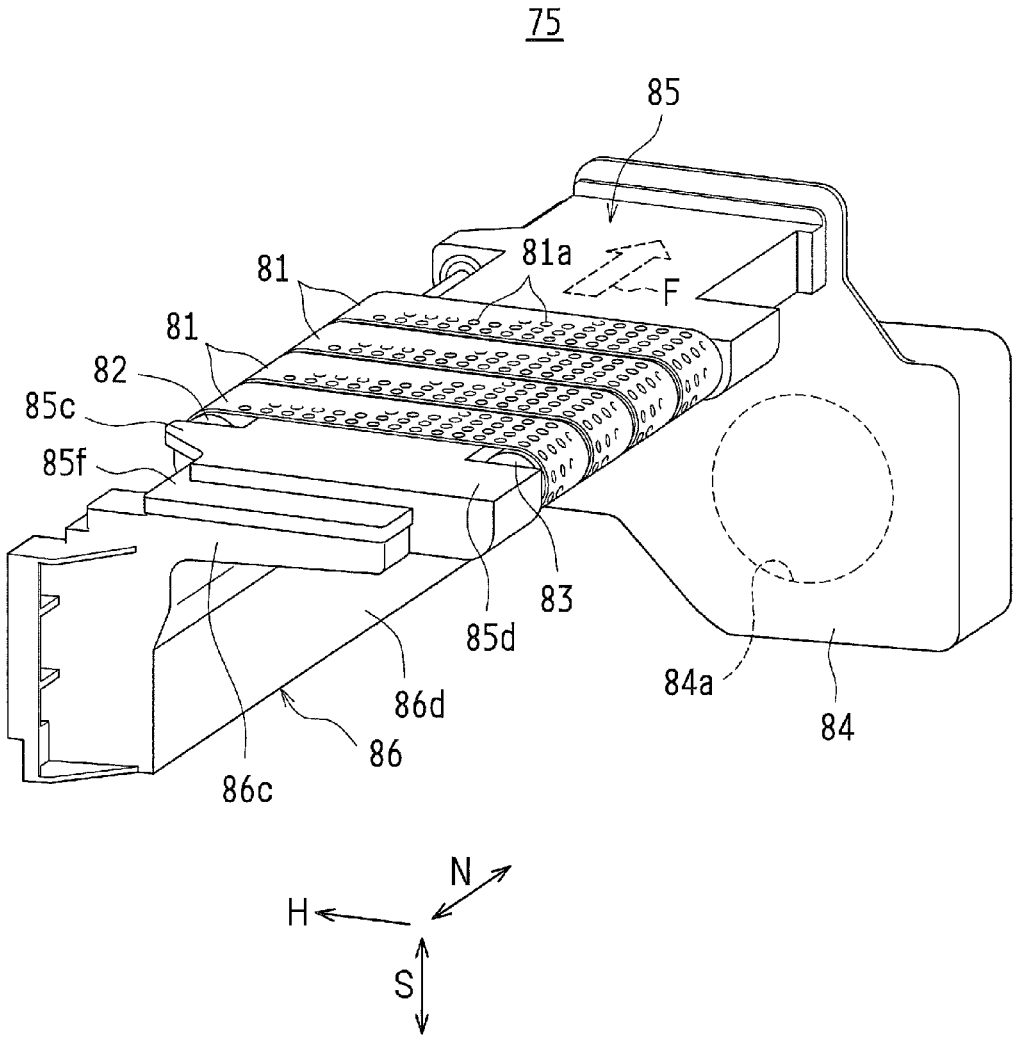
FIG. 6 is a perspective view of the paper drawing section as viewed obliquely downward from the rear.
Figure 7:
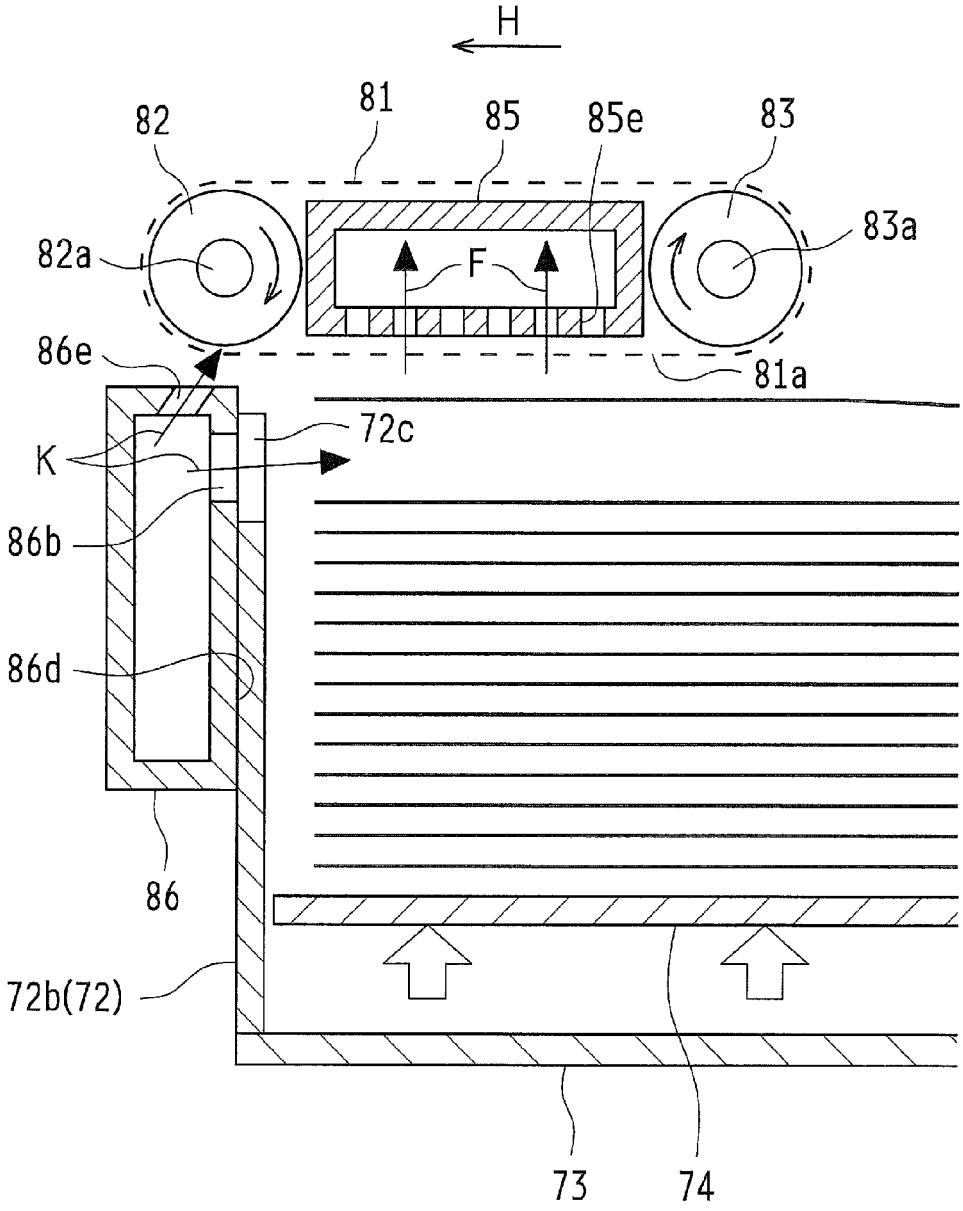
FIG. 7 is an enlarged cross-sectional view primarily showing the paper drawing section as taken according to arrows B-B shown in FIG. 2.

FIG. 4 is a perspective view of the paper drawing section as viewed obliquely downward from the front. FIG. 5 is a perspective view of the paper drawing section as viewed obliquely upward from the rear. FIG. 6 is a perspective view of the paper drawing section as viewed obliquely downward from the rear. FIG. 7 is an enlarged cross-sectional view primarily showing the paper drawing section as taken according to arrows B-B shown in FIG. 2.

The air sucking duct 85 is a hollow body. As illustrated in FIG. 4, the air sucking duct 85 has an air channel extending in the longitudinal direction N and is coupled to the air sucking fan 84 via an sucking-coupling section 85*a* disposed at an end with respect to the longitudinal direction N. The air sucking duct 85 is disposed extending in the longitudinal direction N over the top face of the printing paper stacked on the paper stacking tray 74. The air sucking duct 85 has paper sucking ports 85*e* (see FIG. 7 for detail) on a face thereof that is over the top face of the printing paper (the bottom face 85*g* of the air sucking duct 85). The paper sucking ports 85*e* extend to the internal channel. The air sucking duct 85 has a roller coupling section 85*h* at a front end section 85*c* and another roller coupling section 85*h* at a rear end section 85*d* (see FIG. 4) with respect to the transport direction H. The roller coupling sections 85*h* stick out externally. A roller rotational shaft 82*a* supporting a roller 82 and a roller rotational shaft 83*a* supporting a roller 83 are connected to the roller coupling section 85*h*.

The roller 82 is supported by the roller rotational shaft 82*a*, the roller 83 is supported by the roller rotational shaft 83*a*, and the roller rotational shaft 82*a* and the roller rotational shaft 83*a* are connected to driving means (not shown).

The paper transport belts 81 are stretched around the rollers 82 and 83 and disposed, although not precisely shown, so that the belts 81 are slightly distanced from the top face 85*b* of the air sucking duct 85 and in contact with the bottom face 85*g* of the air sucking duct 85. As the driving means rotates one of the rollers (the roller 82), the other roller 83 is driven to rotate so that the paper transport belts 81 can rotate. In the present embodiment, the paper transport member is an equivalent of the paper transport belts 81. The paper transport belts 81 have numerous air passage holes 81*a* so that air is sucked through the air passage holes 81*a* and the air sucking duct 85 to the air sucking fan 84.

As indicated by arrows F in FIGS. 4 to 6, the air sucking fan 84 sucks air through the paper sucking ports 85*e* and the sucking-coupling section 85*a* to the air inlet 84*a* of the air sucking fan 84. Then, as indicated by arrows F in FIG. 7, that air sucks the top face of the printing paper stacked on the paper stacking tray 74 via the air passage holes 81*a*. The printing paper is drawn on its top face onto the paper transport belts 81 and transported in the transport direction H by the rotation of the paper transport belts 81.

The structure of the air sucking fan 84 and the separation fan 88 will be described later in detail in reference to FIGS. 8A and 8B.

The separation duct 86 is a hollow body. As illustrated in FIG. 4, The separation duct 86 has an air channel extending in the longitudinal direction N and is coupled to the separation fan 88 via a separation coupling section 86*a* (see also FIG. 2) disposed at an end with respect to the longitudinal direction N. As illustrated in FIG. 7, the separation duct 86 is disposed facing the front end of the printing paper stacked on the paper stacking tray 74. The separation duct 86 has the first separation opening 86*b* in a face thereof that faces the front end of the printing paper (internal face 86*d* of the separation duct 86). The first separation opening 86*b* extends to the internal channel. The internal face 86*d* is disposed overlapping the external face of the contact plate 72*b* of the outer frame assembly 72. The first separation opening 86*b* faces the interior of the outer frame assembly 72 via the notch section 72*c*. The separation duct 86 has a second separation opening 86*e* that faces the paper transport belts 81.

As indicated by arrows K in FIGS. 4 and 5, the separation fan 88 feeds air from the air outlet 88*b* through the separation coupling section 86*a* to the first separation opening 86*b* and the second separation opening 86*e*. That air is blown through the first separation opening 86*b* and the second separation opening 86*e* to the interior of the outer frame assembly 72. As indicated by arrows K in FIG. 7, the air blown out through the first separation opening 86*b* is fed at the front end of the printing paper stacked on the paper stacking tray 74 so that a few top sheets of the stacked printing paper can become loosened up. In this circumstance, the air fed through the auxiliary ducts 77 (see FIG. 3) levitates the sheets of printing paper stacked on the paper stacking tray 74 toward the paper transport belts 81 for easy sucking of printing paper. The air blown out through the second separation opening 86*e* is fed between the sheets of printing paper levitated from the paper stacking tray 74 so that the air can separate the individual sheets of printing paper. The top one of the separated sheets is drawn onto the paper transport belts 81, whereas the other sheets are stacked back on the paper stacking tray 74.

The relay duct 87 is a hollow body. As illustrated in FIG. 4, the relay duct 87 has a channel extending in the transport direction H and is coupled at one of its ends to the air outlet 84*b* of the air sucking fan 84 and coupled at the other end to the air inlet 88*a* of the separation fan 88. The air blown out by the air sucking fan 84 is fed to the separation fan 88 via the relay duct 87. The channel in the relay duct 87 will be described later in detail in reference to FIG. 8A.

The relay duct 87 and the separation duct 86 are coupled at a predetermined angle. The separation fan 88 is disposed where the relay duct 87 and the separation duct 86 are coupled. This structure changes the direction of the air that flows through the separation fan 88 and provides the separation duct 86 along the air flow coming from the separation fan 88. That in turn reduces the loss that would otherwise be caused by wall faces and other obstacles, thereby achieving efficient printing paper separation.

Specifically, the predetermined angle is from 80° to 100° and preferably equal to 90°. In other words, the relay duct 87 and the separation duct 86 are coupled at a 90° angle. This 90° coupling enables air to be fed normal to the air inlet 88*a* of the separation fan 88. The separation fan 88 hence collects air efficiently.

The air coming out of the separation duct 86 is partially sucked into the air sucking duct 85. This arrangement establishes an air channel between the separation duct 86 and the air sucking duct 85. Therefore, circulating air that flows in the paper feeding device 71 reduces loss of air for efficient operation.

An end (sucking front end section 85*f*) of the air sucking duct 85 that is opposite the sucking-coupling section 85*a* is connected to an end (separating front end section 86*c*) of the separation duct 86 that is opposite the separation coupling section 86*a*. Although FIGS. 4 to 6 show the relay duct 87 being separately formed from the air sucking duct 85 and the separation duct 86, the present invention is by no means limited to this concrete example. Alternatively, the air sucking duct 85, the separation duct 86, and the relay duct 87 may be formed as a single body. In other words, the relay duct 87, the sucking-coupling section 85*a*, and the separation coupling section 86*a* may be formed as a single body by, for example, providing the relay duct 87 with thick external walls, so long as channels that correspond to the air sucking duct 85, the separation duct 86, and the relay duct 87 are independently formed.

Figure 12:
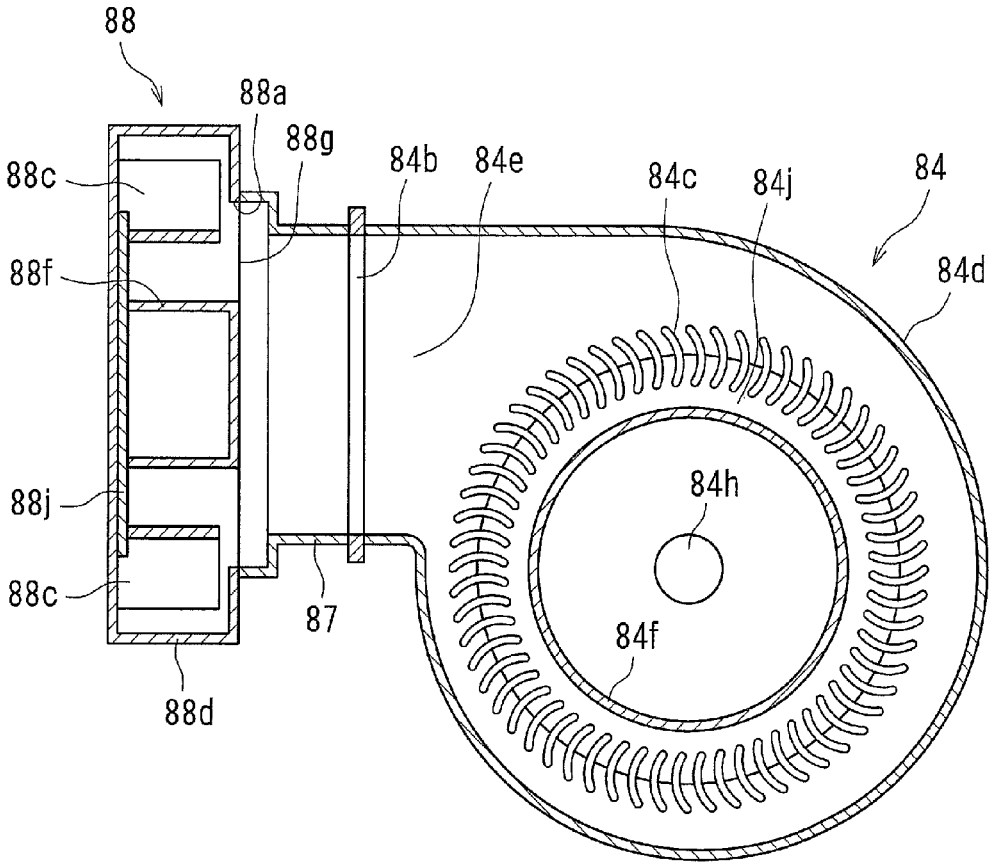
FIG. 12 is a cross-sectional view taken according to arrows C-C in FIG. 9.

Next, the air sucking fan and the separation fan will be described in reference to FIGS. 8A, 8B, and 12.

Figure 8A:
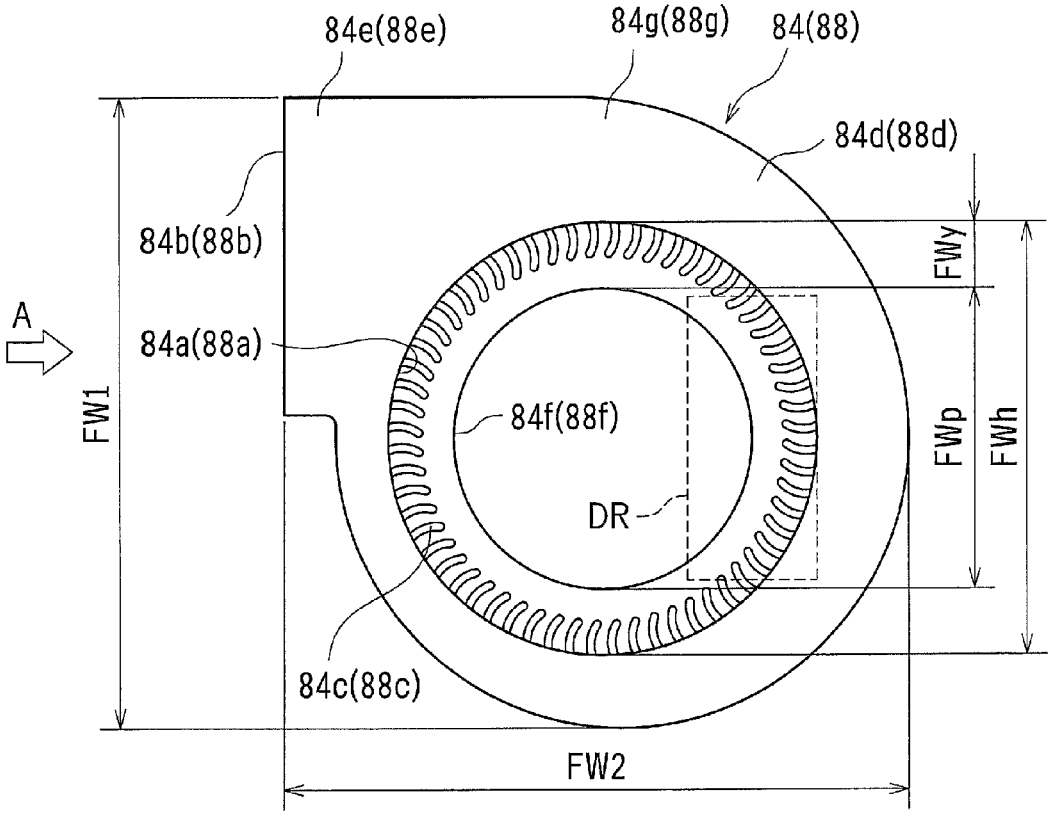
FIG. 8A is a front view of only an air sucking fan and a separation fan.
Figure 8B:
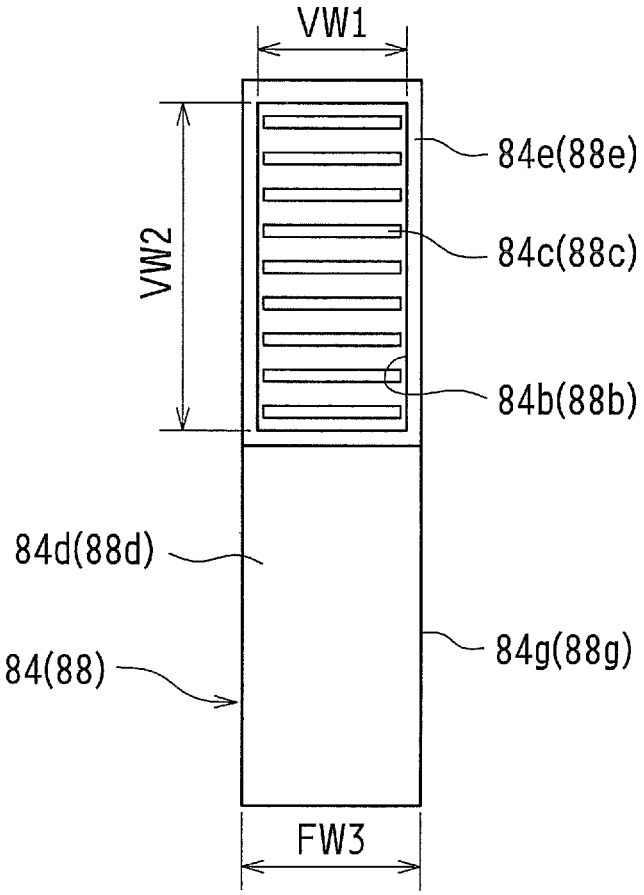
FIG. 8B is a side view of the air sucking fan and the separation fan as viewed from the direction indicated by arrow A in FIG. 8A.

FIG. 8A is a front view of only the air sucking fan and the separation fan. FIG. 8B is a side view of the air sucking fan and the separation fan as viewed from the direction indicated by arrow A in FIG. 8A. FIG. 12 is a cross-sectional view taken according to arrows C-C in FIG. 9.

The air sucking fan 84 is, for example, a sirocco fan or like centrifugal fan. The air sucking fan 84 sucks in air through the air inlet 84*a* and pressurizes it before blowing out through the air outlet 84*b*. The air sucking fan 84 includes blades 84*c*, a fan casing 84*d*, and a duct section 84*e*. In the present embodiment, the separation fan 88 has a similar structure to the air sucking fan 84, and its description is omitted here.

The blades 84*c* are rotated by driving means (not shown) to send air radially outside the air sucking fan 84 by means of the centrifugal force generated by its rotation. A bearing section 84*f* is disposed at the center of the air inlet 84*a*. The blades 84*c* are disposed radially around the bearing section 84*f*. The blades 84*c* are disposed, for example, standing on a circular plate 84*j* connected to a rotation axis 84*h*. The bearing section 84*f* includes therein the rotation axis 84*h* connected to driving means. The circular plate 84*j* rotates around the rotation axis 84*h* to achieve rotational motion of the blades 84*c*.

The fan casing 84*d* has a columnar space that contains the blades 84*c* therein. The fan casing 84*d* is substantially cylindrical and provided with the air inlet 84*a* on a substantially circular, primary face 84*g*. The primary face 84*g* of the fan casing 84*d* is, for example, 120 mm wide (housing vertical width FW1). A side face of the fan casing 84*d* has an opening through which the air sucking fan 84 is coupled to the duct section 84*e*. The side face of the fan casing 84*d* is, for example, 33 mm wide (side face width FW3). The air inlet 84*a* is circular in a front view and has a diameter (opening diameter FWh) of, for example, 80 mm.

The bearing section 84*f* is formed like a cup sticking out at the primary face 84*g* and has a diameter (rotation axis width FWp) of, for example, 58 mm. In the following, the width from the bearing section 84*f* to the air inlet 84*a* in a front view may be referred to as an effective opening width FWy for the sake of description. Air can be moved into the air sucking fan 84 by supplying air between the bearing section 84*f* and the air inlet 84*a* (effective opening width FWy). In contrast, the air that hits the bearing section 84*f* returns without entering the interior of the air sucking fan 84. In the following, the region where the air sucking fan 84 is able to suck in air will be referred to as the air sucking region, and the air sucking region corresponds to the effective opening width FWy. There is provided a gap between the blades 84*c* and the bearing section 84*f* in the present embodiment. The distance between the blades 84*c* and the bearing section 84*f* may be adjusted in a suitable manner so long as the blades 84*c* are partially located in the effective opening width FWy in a front view.

The duct section 84*e* is a hollow tube having a rectangular cross-section normal to the air flow direction and is formed integral to the fan casing 84*d*. The duct section 84*e* is coupled at one of its ends to a side face of the fan casing 84*d* and at the other end, constitutes the air outlet 84*b* to externally eject the air that flows through the internal channel of the duct section 84*e*. The width (housing horizontal width FW2) from the air outlet 84*b* to the other end of the fan casing 84*d* in a front view is, for example, 120 mm. As mentioned earlier, in a side view, the air outlet 84*b* is rectangular. The air outlet 84*b* has an opening width (ejection horizontal width VW1) of, for example, 26 mm in the direction of the rotation axis and an opening width (ejection vertical width VW2) of, for example, 51 mm in the direction normal to the rotation axis. In other words, the air outlet 84*b* has a greater ejection vertical width VW2 than the ejection horizontal width VW1.

The air sucking fan 84 and the separation fan 88 have the same structure. The air inlet 88*a*, air outlet 88*b*, blades 88*c*, fan casing 88*d*, duct section 88*e*, bearing section 88*f*, primary face 88*g*, rotation axis 88*h*, and circular plate 88*j* of the separation fan 88 are equivalents of the air inlet 84*a*, air outlet 84*b*, blades 84*c*, fan casing 84*d*, duct section 84*e*, bearing section 84*f*, primary face 84*g*, rotation axis 84*h*, and circular plate 84*j* of the air sucking fan 84 respectively.

As mentioned earlier, the air sucking fan 84 and the separation fan 88, being identical, facilitates reduction of unwanted noise generated by the fans. If the fans have approximately equal rotational speeds and cycles, the frequencies of their unwanted noise are confined to a narrow range of frequencies. The noise can be thus reduced without addressing a wide range of frequencies.

As mentioned earlier, the widths of the air sucking fan 84 and the separation fan 88 are determined by the widths (housing vertical width FW1, housing horizontal width FW2, and side face width FW3) of the fan casing 84*d* and the duct section 84*e*. In the present embodiment, the side face width FW3 is the smallest width, and the air sucking fan 84 and the separation fan 88 have the smallest widths in the direction of the rotation axis.

The separation fan 88 is preferably set up to generate a higher wind pressure than does the air sucking fan 84. According to the setup, the separation fan 88 generates an increased wind pressure, which compensates for the loss that occurs during its passage in the relay duct 87. A longer channel inevitably lowers the wind pressure, albeit slightly. An output difference between the fans ensures a consistent wind pressure. Specifically, the wind pressure of the air sucking fan 84 is 200 Pa, and the wind pressure of the separation fan 88 is 380 Pa.

The broken lines in FIG. 8A, in a front view, indicate the channel (duct region DR) in the relay duct 87 as projected onto the primary face 88*g* of the separation fan 88. The duct region DR is rectangular and has a width of 26 mm in the longitudinal direction N (horizontal direction in the figure) and a width of 51 mm in the stacking direction S (vertical direction in the figure). In other words, the duct region DR has the same shape as the air outlet 84*b* of the air sucking fan 84. The duct region DR is preferably as large as, or larger than, the air outlet 84*b* of the air sucking fan 84.

The duct region DR is preferably positioned to face the blades 88*c* and to maximize the area in which the duct region DR overlaps a part of the effective opening width FWy. In other words, when the area in which the duct region DR overlaps a part of the effective opening width FWy is a maximum, the air outlet 84*b* of the air sucking fan 84 is disposed at such a position that the area in which the air outlet 84*b* overlaps the air sucking region is maximized. According to the structure, the separation fan 88 sucks in as much of the air coming out of the air sucking fan 84 as possible. That in turn increases the air coming out of the separation fan 88. In other words, the air fed directly into the separation fan is increased by increasing the area of the opening that faces the air sucking region. The area in which the air outlet 84*b* of the air sucking fan 84 overlaps the air sucking region is the area in which the air outlet 84*b* overlaps the effective opening width FWy in a front view of the primary face 88*g* of the separation fan 88.

As mentioned earlier, the relay duct 87 has an opening that faces the blades 88*c* of the separation fan 88. According to the structure, the air coming out of the relay duct 87 directly hits the blades 88*c* of the separation fan 88, which enables efficient feeding of air to the separation fan 88.

The air sucking region is shaped like a circular ring, and the air outlet 84*b* of the air sucking fan 84 is rectangular, when viewed normal to a plane (primary face 88*g*) in which the air inlet 88*a* of the separation fan 88 lies. Preferably, one of sides of a projection of the air outlet 84*b* of the air sucking fan 84 onto the separation fan 88 matches a tangent to an external circle of the air sucking region. The structure specifies the position of the air outlet 84*b* of the air sucking fan 84. That in turn facilitates designing of a structure that maximizes the area in which the air outlet 84*b* of the air sucking fan 84 overlaps the air sucking region.

In the present embodiment, the longer sides of the air outlet 84*b* of the air sucking fan 84 are disposed at a position (right end of the air inlet 88*a* of the separation fan 88) where the distance from the air outlet 88*b* of the separation fan 88 as measured in the longitudinal direction N (horizontal direction in FIG. 8A) is a maximum. Alternatively, for example, the longer sides may be disposed at a position (left end of the air inlet 88*a* of the separation fan 88) where the distance from the air outlet 88*b* of the separation fan 88 as measured in the longitudinal direction N is a minimum. In addition, although the longer sides of the air outlet 84*b* of the air sucking fan 84 are disposed normal to the longitudinal direction N, the longer sides may be tilted with respect to the longitudinal direction N so long as the longer sides match the tangent to the air outlet 88*b* of the separation fan 88.

If the air inlet 88*a* of the separation fan 88 and the opening of the relay duct 87 have different shapes, the air coming out of the relay duct 87 may be prevented from leaking to the outside by, for example, expanding only the part of the opening in which the separation fan 88 is coupled to the relay duct 87 in width according to the air inlet 88*a*. The same arrangement could apply to the coupling of the air sucking fan 84 and the air sucking duct 85 (sucking-coupling section 85*a*). In addition, the relay duct 87 may cover the primary face 88*g* so that the air coming out of the opening of the relay duct 87 could be vented only to the region that is part of the air inlet 88*a* facing the air outlet 84*b*.

Next will be described the size of the paper drawing section in reference to drawings.

Figure 9:
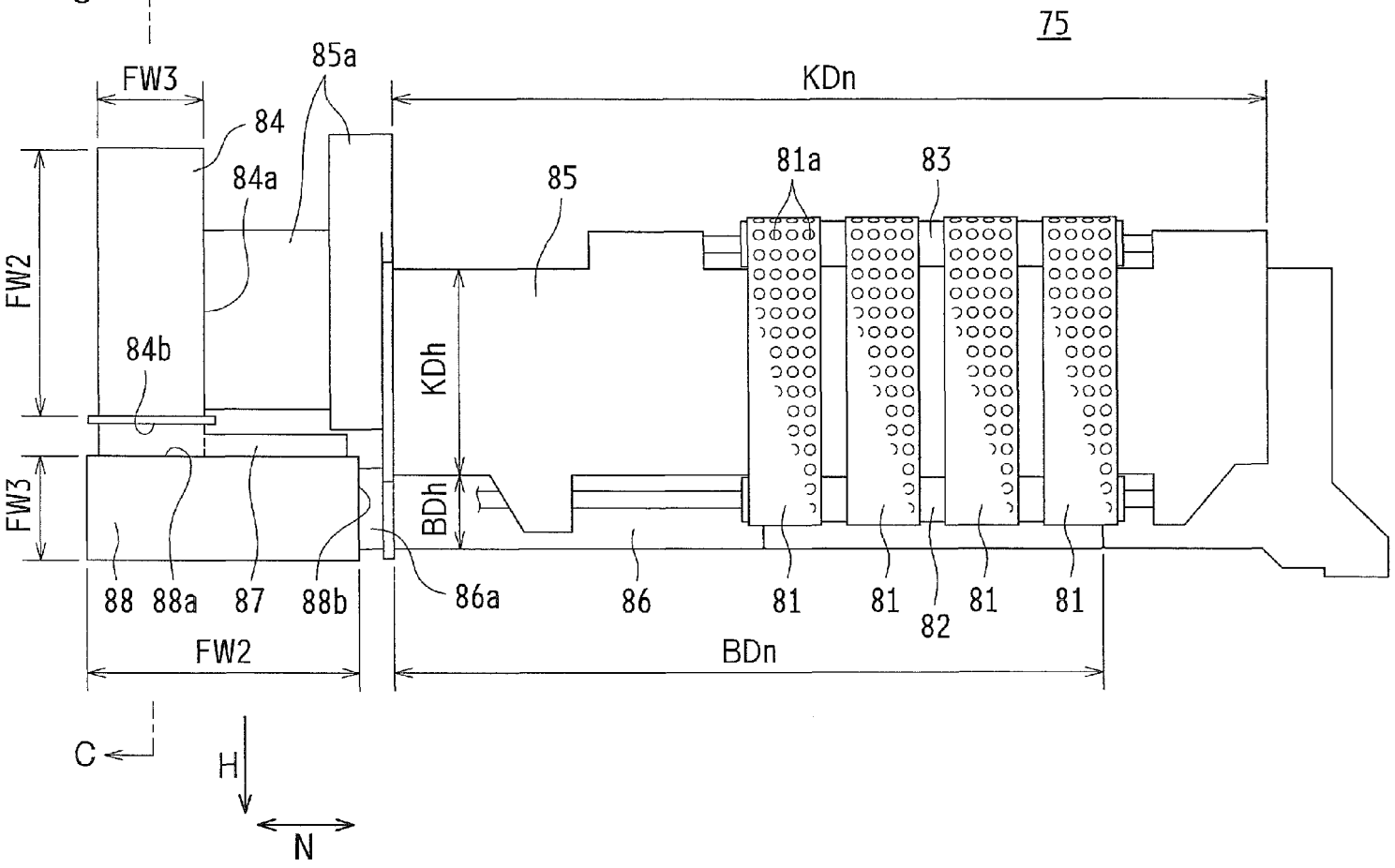
FIG. 9 is a plan view of the removed paper drawing section.
Figure 10:
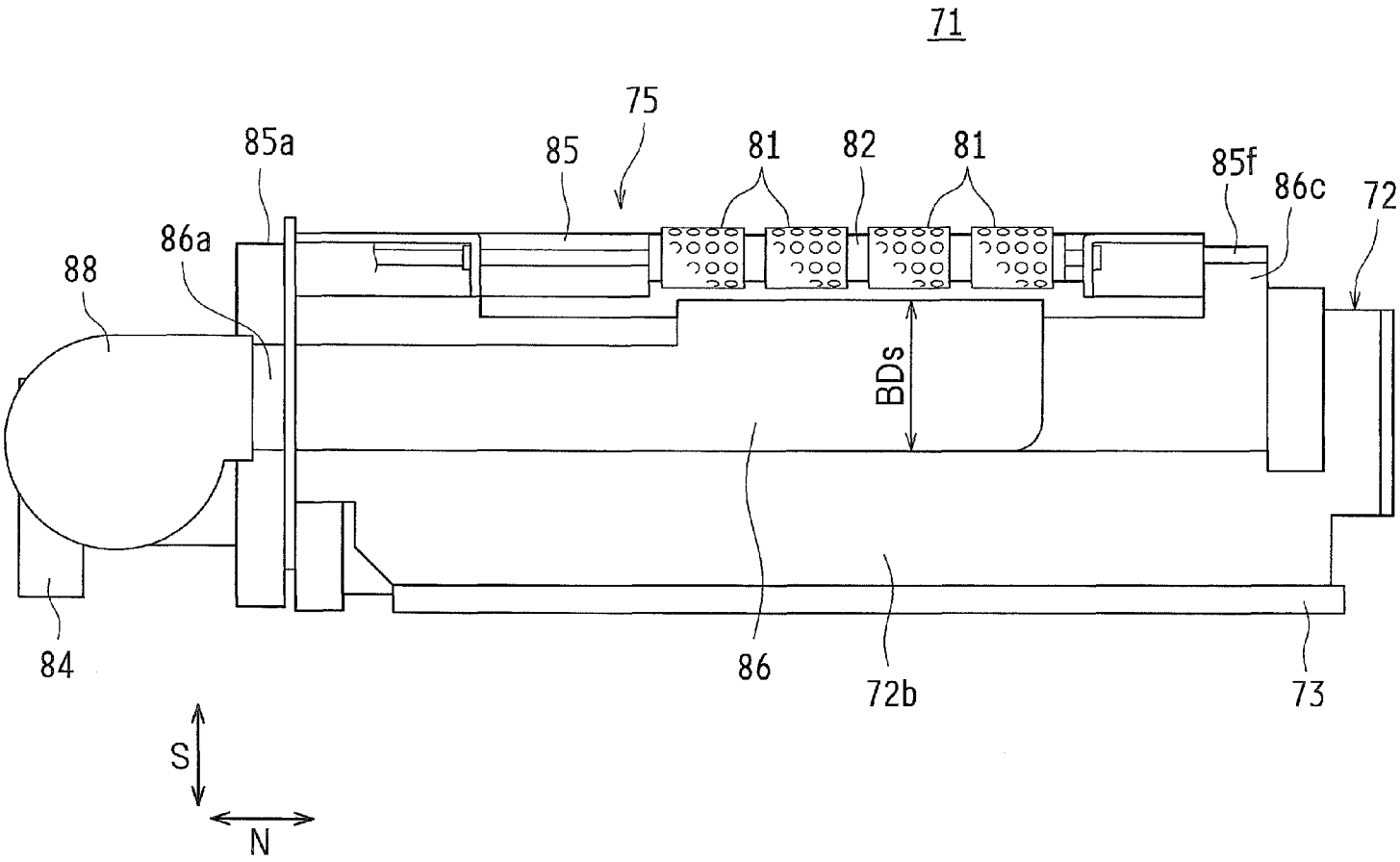
FIG. 10 is a side view of the paper feeding device shown in FIG. 2.

FIG. 9 is a plan view of the removed paper drawing section. FIG. 10 is a side view of the paper feeding device shown in FIG. 2.

The air sucking duct 85 (except for the sucking-coupling section 85*a*) has a width KDn of 455 mm in the longitudinal direction N, a width KDh of 50 mm in the transport direction H, and a width KDs (see FIG. 5) of 25 mm in the stacking direction S. The air sucking duct 85 is thus longer in the longitudinal direction N, and the longitudinal direction N of the air sucking duct 85 matches the longitudinal direction N.

The separation duct 86 (except for the separation coupling section 86*a* and the separating front end section 86*c*) has a width BDn of 395 mm in the longitudinal direction N, a width BDh of 33 mm in the transport direction H, and a width BDs of 65 mm in the stacking direction S. The separation duct 86 is thus longer in the longitudinal direction N, and the longitudinal direction N of the separation duct 86 matches the longitudinal direction N. The width BDh of the separation duct 86 in the transport direction H is a minimum width, and the transport direction H is a minimum width direction of the separation duct 86.

The air sucking fan 84 has the air inlet 84*a* in a plane normal to the longitudinal direction N and the air outlet 84*b* in a plane normal to the transport direction H. The rotation axis of the air sucking fan 84 thus extends in the longitudinal direction N. Therefore, the minimum width direction of the air sucking fan 84 matches the longitudinal direction N.

The separation fan 88 has the air inlet 88*a* in a plane normal to the transport direction H and the air outlet 88*b* in a plane normal to the longitudinal direction N. The rotation axis of the separation fan 88 thus extends in the transport direction H. Therefore, the minimum width direction of the separation fan 88 matches the transport direction H.

As mentioned earlier, the air sucking fan 84 is disposed so that the longitudinal direction N of the air sucking duct 85 matches the minimum width direction of the air sucking fan 84, with the longitudinal direction N being along the front end of the printing paper stacked on the paper stacking tray 74. The separation duct 86 is disposed so that the longitudinal direction N of the air sucking duct 85 is along the longitudinal direction N of the separation duct and that the transport direction H matches the minimum width direction of the separation duct 86. The separation fan 88 is disposed so that the minimum width direction of the separation duct 86 is along the minimum width direction of the separation fan 88.

According to the structure, the minimum width direction of the air sucking fan 84 matches the longitudinal direction of the air sucking duct 85. That reduces the width of the paper drawing section 75 constituted by ducts and fans in a longitudinal direction N. The matching of the minimum width directions of the separation duct 86 and the separation fan 88 with the transport direction H reduces the width of the paper drawing section 75 in the transport direction H. Reducing the widths in the longitudinal direction N and in the transport direction H to possible minimums allows for reduction of the paper feeding device 71 in size.

The separation fan 88 has the air outlet 88*b* in a plane normal to the longitudinal direction N, and the air outlet 88*b* of the separation fan 88 is wider in the stacking direction S (ejection vertical width VW2) than in the transport direction H (ejection horizontal width VW1). According to the structure, the air outlet 88*b* of the separation fan 88 is wider in the stacking direction S, which ensures a sufficient cross-sectional area for the channel Since the separation fan 88 and the separation duct 86 have their minimum width directions matched with the transport direction H, the separation fan 88 and the separation duct 86 are not allowed to have an increased width in the transport direction H. Their widths can however be readily increased in the stacking direction S in which a predetermined area is ensured for the provision of the paper stacking tray 74.

The air sucking fan 84 has the air outlet 84*b* in a plane normal to the transport direction H, and the air outlet 84*b* of the air sucking fan 84 is wider in the stacking direction S (ejection vertical width VW2) than in the longitudinal direction N (ejection horizontal width VW1). According to the structure, the air outlet 84*b* of the air sucking fan 84 is wider in the stacking direction S, which ensures a sufficient cross-sectional area for the channel. Since the air sucking fan 84 has its minimum width direction matched with the longitudinal direction N of the air sucking duct 85, the air sucking fan 84 is not allowed to have an increased width in the longitudinal direction N. Its width can however be readily increased in the stacking direction S in which a predetermined area is ensured for the provision of the paper stacking tray 74.

As illustrated in FIG. 9, the air sucking duct 85, the relay duct 87, and the separation duct 86 have a horseshoe-like shape in a planar view. Therefore, the air sucking duct 85 and the separation duct 86 extend in the same direction from the relay duct 87. That enables the footprint of the paper feeding device 71 to be reduced, allowing for reduction in size. That also facilitates designing of a structure in which the air sucking duct 85 and the separation duct 86 are closely located, readily allowing air to circulate from the separation duct 86 to the air sucking duct 85.

Next will be described the paper feed operation by a paper feeding device in reference to FIGS. 2 and 11.

Figure 11:
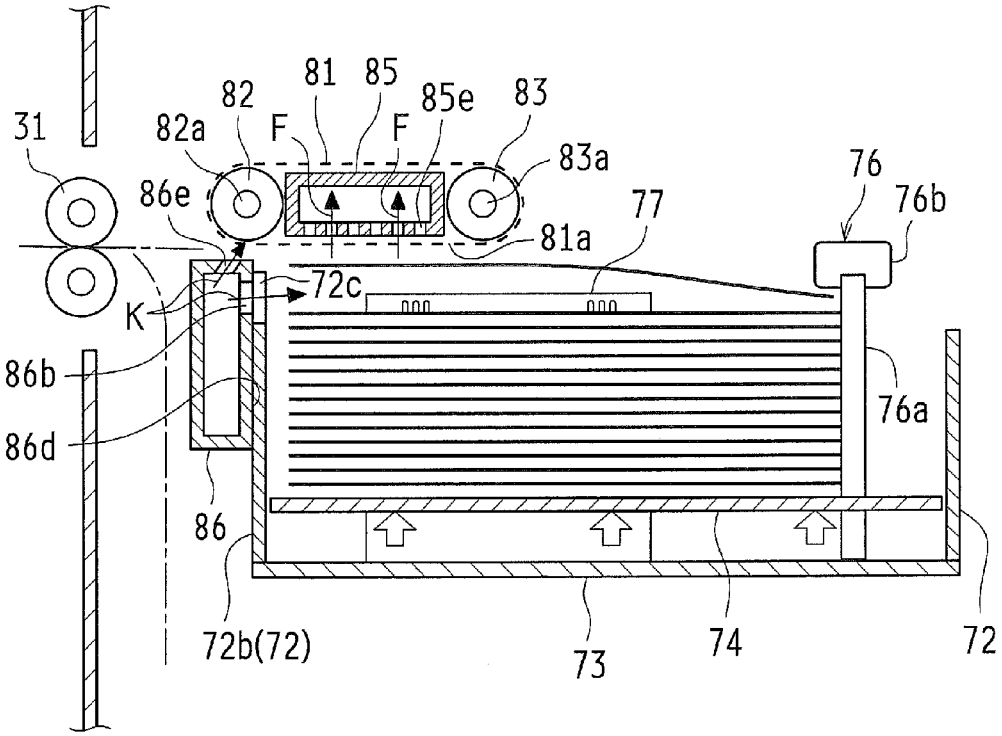
FIG. 11 is a simplified cross-sectional view of a paper feeding device in accordance with an embodiment of the present invention.

FIG. 11 is a simplified cross-sectional view of a paper feeding device in accordance with an embodiment of the present invention.

First, sheets of printing paper are stacked on the paper stacking tray 74 and properly positioned. To stack printing paper on the paper stacking tray 74, the printing paper rear end guide 76 is pushed backward to move the printing paper rear end guide 76 and the contact plate 72*b* away from each other. Then, the auxiliary ducts 77 are moved away from each other in such directions that the auxiliary ducts 77 can be mutually separated. In this situation, printing paper is stacked on the paper stacking tray 74, and the printing paper rear end guide 76 is pushed forward so that the guiding pillar section 76*a* can push the rear end of the printing paper in the transport direction H. The printing paper, pushed by the guiding pillar section 76*a*, slips on the paper stacking tray 74 until its front end comes in contact with the contact plate 72*b*. The front and rear ends of the printing paper are thus sandwiched between the contact plate 72*b* and the guiding pillar section 76*a* for positioning of the printing paper. The auxiliary ducts 77 are moved in such directions that the auxiliary ducts 77 can mutually come closer. Both ends of the printing paper with respect to the longitudinal direction N are thus sandwiched between two auxiliary ducts 77 for positioning of the printing paper.

Next, the wind-up pulleys 90 (see FIG. 3) are rotated to elevate the paper stacking tray 74 for positioning of the printing paper at a predetermined height. The paper stacking tray 74 is elevated, for example, until the top sheet of printing paper comes into contact with the guiding head section 76*b*.

Air is then fed to the auxiliary ducts 77 to blow air from the auxiliary ducts 77 above the side faces of the printing paper stacked on the paper stacking tray 74 to levitate sheets of printing paper. Air is also fed from the air sucking fan 84 and the separation fan 88 to the separation duct 86 to blow air from the first separation opening 86*b* at the front end of the printing paper, to loosen up the sheets of printing paper. In this situation, the air blown out of the second separation opening 86*e* separates the levitated sheets of printing paper.

Air is then sucked by the air sucking fan 84 and the separation fan 88 through the air sucking duct 85, the air passage holes 81*a*, and the paper sucking ports 85*e* to draw (suck) a sheet of printing paper onto the paper transport belts 81. In response to this, the rollers 82 and 83 are rotated to rotate the paper transport belts 81. The sheet is thus drawn out of the stack and transported in the transport direction H to the transport rollers 31 in the image forming device 1. Another sheet of printing paper is then drawn (sucked) onto the paper transport belts 81 and transported. Following that, more printing paper is transported in the same manner, a sheet at a time, from the paper feeding device 71 to the image forming device 1.

As mentioned earlier, the image forming device 1 includes the paper feeding device 71. According to the structure, the image forming device 1, including the paper feeding device 71 in accordance with the present invention, achieves the same functions and effects as the paper feeding device 71 in accordance with the present invention.

The aforementioned examples are for illustrative purposes only in every respect and should not be subjected to any restrictive interpretations. The scope of the present invention is defined only by the claims and never bound by the specification. Those modifications and variations that may lead to equivalents of claimed elements are all included within the scope of the invention.

REFERENCE SIGNS LIST

1 Image Forming Device
71 Paper Feeding Device
74 Paper Stacking Tray
81 Paper Transport Belt (Exemplary Paper Transport Member)
84 Air Sucking Fan
84*a* Air Inlet (Part of Air Sucking Fan)
84*b* Air Outlet (Part of Air Sucking Fan)
85 Air Sucking Duct
86 Separation Duct
87 Relay Duct
88 Separation Fan
88*a* Air Inlet (Part of Separation Fan)
88*b* Air Outlet (Part of Separation Fan)
H Transport Direction
N Longitudinal direction
S Stacking Direction

The invention claimed is:

1. A paper feeding device, comprising:

a paper stacking tray that carries thereon stacked sheets of printing paper and moves up/down along a stacking direction of the sheets of printing paper, wherein a longitudinal direction is along a front end of the printing paper stacked on the paper stacking tray;

a paper transport member that sucks in air to suck and transport a sheet of printing paper stacked on the paper stacking tray;

a separation duct that, disposed facing the front end of the printing paper stacked on the paper stacking tray, constitutes a channel for air separating the printing paper;

a separation fan that, coupled to an end of the separation duct with respect to the longitudinal direction, generates an air flow separating the printing paper stacked on the paper stacking tray;

an air sucking duct that, disposed in the longitudinal direction facing a top face of the printing paper stacked on the paper stacking tray, constitutes a channel for air sucking a sheet of printing paper stacked on the paper stacking tray;

an air sucking fan that, coupled to an end of the air sucking duct with respect to the longitudinal direction, generates an air flow separating the printing paper stacked on the paper stacking tray; and a relay duct that guides air coming out of the air sucking fan to the separation fan, wherein the air sucking fan and the separation fan are arranged so that the air sucking fan and the separation fan have rotation axes thereof substantially parallel to a top face of the printing paper stacked on the paper stacking tray and also so that the air sucking fan ejects air from an air outlet thereof in the same direction as the separation fan sucks in air through an air inlet thereof; and the relay duct extends along a straight line from the air outlet of the air sucking fan to the air inlet of the separation fan.

2. The paper feeding device as set forth in claim 1, wherein the relay duct and the separation duct are coupled at a predetermined angle, and the separation fan is disposed where the relay duct and the separation duct are coupled.

3. The paper feeding device as set forth in claim 2, wherein the predetermined angle is equal to 90°.

4. The paper feeding device as set forth in claim 2, wherein the air sucking duct sucks in air coming out of the separation duct.

5. The paper feeding device as set forth in claim 1, wherein the relay duct has an opening that faces blades of the separation fan.

6. The paper feeding device as set forth in claim 1, wherein the air outlet of the air sucking fan is disposed at such a position that the air outlet of the air sucking fan overlaps a part of an air sucking region from which the separation fan sucks in air and that an area in which the air outlet of the air sucking fan overlaps the air sucking region is maximized.

7. The paper feeding device as set forth in claim 6, wherein the air sucking region is shaped like a circular ring, and the air outlet of the air sucking fan is rectangular, when viewed normal to a plane in which the air inlet of the separation fan lies, and one of sides of a projection of the air outlet of the air sucking fan onto the separation fan matches a tangent to an external circle of the air sucking region.

8. A paper feeding device, comprising:

a paper stacking tray that carries thereon stacked sheets of printing paper and moves up/down along a stacking direction of the sheets of printing paper;

a paper transport member that sucks in air to suck and transport a sheet of printing paper stacked on the paper stacking tray;

letting a longitudinal direction be along a front end of the printing paper stacked on the paper stacking tray, a separation duct that, disposed facing the front end of the printing paper stacked on the paper stacking tray, constitutes a channel for air separating the printing paper;

a separation fan that, coupled to an end of the separation duct with respect to the longitudinal direction, generates an air flow separating the printing paper stacked on the paper stacking tray;

an air sucking duct that, disposed in the longitudinal direction facing a top face of the printing paper stacked on the paper stacking tray, constitutes a channel for air sucking the sheet of printing paper stacked on the paper stacking tray; and an air sucking fan that, coupled to an end of the air sucking duct with respect to the longitudinal direction, generates an air flow sucking the sheet of printing paper stacked on the paper stacking tray, wherein the air sucking fan is disposed so that a longitudinal direction of the air sucking duct matches a minimum width direction of the air sucking fan, the separation duct is disposed along the longitudinal direction and such that a transport direction of the printing paper matches a minimum width direction of the separation duct, and the separation fan is disposed so that the minimum width direction of the separation duct is along a minimum width direction of the separation fan.

9. The paper feeding device as set forth in claim 8, wherein the separation fan has an air outlet in a plane normal to the longitudinal direction, the air outlet of the separation fan being wider in the stacking direction than in the transport direction.

10. The paper feeding device as set forth in claim 8, wherein the air sucking fan has an air outlet in a plane normal to the transport direction, the air outlet of the air sucking fan being wider in the stacking direction than in the longitudinal direction.

11. The paper feeding device as set forth in claim 8, further comprising a relay duct that guides air coming out of the air sucking fan to the separation fan, wherein the relay duct and the separation duct are coupled at a predetermined angle, and the separation fan is disposed where the relay duct and the separation duct are coupled.

12. The paper feeding device as set forth in claim 11, wherein the predetermined angle is equal to 90°.

13. The paper feeding device as set forth in claim 11, wherein the relay duct has an opening that faces blades of the separation fan.

14. The paper feeding device as set forth in claim 1, wherein the air sucking fan and the separation fan have a common structure.

15. The paper feeding device as set forth in claim 1, wherein the separation fan generates a higher wind pressure than does the air sucking fan.

16. An image forming device, comprising the paper feeding device as set forth in claim 1.

17. The paper feeding device as set forth in claim 8, wherein the air sucking fan and the separation fan have a common structure.

18. The paper feeding device as set forth in claim 8, wherein the separation fan generates a higher wind pressure than does the air sucking fan.

19. An image forming device, comprising the paper feeding device as set forth in claim 8.

20. The paper feeding device as set forth in claim 1, wherein the air outlet of the air sucking fan and the air inlet of the separation fan face each other.

* * * * *